United States Patent [19]

Bordon

[11] Patent Number: 4,527,636

[45] Date of Patent: Jul. 9, 1985

[54] SINGLE-WIRE SELECTIVE PERFORATION SYSTEM HAVING FIRING SAFEGUARDS

[75] Inventor: Ernesto E. Bordon, Houston, Tex.

[73] Assignee: Schlumberger Technology Corporation, Houston, Tex.

[21] Appl. No.: 394,949

[22] Filed: Jul. 2, 1982

[51] Int. Cl.[3] ..... E21B 43/116

[52] U.S. Cl. ..... 175/4.55; 166/296; 102/217; 361/249

[58] Field of Search ..... 175/4.55; 361/248, 249; 166/296; 102/317, 319, 322, 315, 217

[56] References Cited

U.S. PATENT DOCUMENTS

| | | | |
|---|---|---|---|
| 2,297,006 | 9/1942 | Lohman | 164/0.5 |
| 2,546,686 | 3/1951 | Bickel et al. | 102/27 |
| 2,821,136 | 1/1958 | Castel | 102/21.6 |
| 2,871,784 | 2/1959 | Blair | 102/21.6 |
| 3,010,396 | 11/1961 | Coleman | 102/21.6 |
| 3,102,476 | 9/1963 | Naeseth | 102/22 |
| 3,126,964 | 3/1964 | Rue | 166/55.5 |
| 3,133,231 | 5/1964 | Fail et al. | 317/80 |
| 3,246,707 | 4/1966 | Bell | 175/4.54 |
| 3,306,208 | 2/1967 | Bergey et al. | 102/70.2 |
| 3,312,869 | 4/1967 | Werner | 317/80 |
| 3,316,451 | 4/1967 | Silberman | 317/80 |
| 3,327,791 | 6/1967 | Harrigan, Jr. | 175/4.55 |
| 3,327,792 | 6/1967 | Boop | 175/4.54 |
| 3,380,540 | 4/1968 | Fields | 175/4.55 |
| 3,417,259 | 12/1968 | Nozawa et al. | 307/108 |
| 3,424,924 | 1/1969 | Leisinger et al. | 307/252 |
| 3,441,093 | 4/1969 | Boop | 175/4.55 |
| 3,517,757 | 6/1970 | Hart | 175/4.55 |
| 3,517,758 | 6/1970 | Schuster | 175/4.55 |
| 3,571,605 | 3/1971 | Dobson | 307/41 |
| 3,603,844 | 9/1971 | Fritz | 317/80 |
| 3,717,095 | 2/1973 | Vann | 102/21.6 |
| 3,748,955 | 7/1973 | Gatermann et al. | 89/1.814 |
| 3,768,408 | 10/1973 | Hallmark | 102/21.6 |
| 3,773,120 | 11/1973 | Stroud et al. | 175/4.55 |
| 3,934,514 | 1/1976 | Dawkins | 102/70.2 |
| 4,007,796 | 2/1977 | Boop | 175/4.55 |
| 4,051,907 | 10/1977 | Estes | 175/4.55 |
| 4,100,978 | 7/1978 | Boop | 175/4.55 |
| 4,157,069 | 6/1979 | Gustafsson et al. | 102/200 |
| 4,208,966 | 6/1980 | Hart | 102/20 |

*Primary Examiner*—Stephen J. Novosad
*Assistant Examiner*—Bruce M. Kisliuk

[57] ABSTRACT

A method and system for selecting and arming each of a plurality of firing modules in a single-line selective perforating system is disclosed. A single firing line connects each firing module one at a time in a sequence to a control unit to receive power and control signals therefrom. Each module generates internally a module active time interval in response to being connected to the firing line power. Each time interval has a first portion during which the module generates an identification pulse to the control unit to uniquely identify that a particular module has been connected to the firing line, and a second portion during which the module is enabled to receive a selection pulse from the control unit to terminate further sequencing of the modules to locate the module to be selected. The next module to receive power from the control unit is connected to the firing line by a pass-through switch in the last connected module at the end of its active time interval if that module was not selected.

51 Claims, 3 Drawing Figures

SINGLE-WIRE SELECTIVE PERFORATION SYSTEM HAVING FIRING SAFEGUARDS

CROSS-REFERENCE TO RELATED APPLICATION

Reference is hereby made to a related co-pending application Ser. No. 394,948, and entitled "A Single-Wire Selective Perforation System," filed concurrently herewith. Both the present application and the cross referenced application are assigned to the same Assignee.

BACKGROUND OF THE INVENTION

This invention relates to perforating guns used in well completion operations. More particularly, the present invention relates to a single-wire selective gun perforating system capable of selecting and firing in an arbitrary order each gun in a plurality of guns connected in a firing string where the selection process includes safeguards for detecting faults in the firing string prior to the firing of a gun.

Typical prior-art perforating guns generally used in well completion operations consist of a plurality of guns connected vertically to form an assembly or firing string suitable for lowering into a well borehole. Each gun will contain one or more shaped charges. Each charge will have a detonator or blasting cap connectable to a firing wire for receiving an electrical firing pulse to detonate the charges.

It is often desirable in well completion operations to have each gun selectable for firing rather than having all guns firing at the same time. Firing all guns at the same time produces a perforation spacing determined by the spacing of the guns in the string, usually in a closely-spaced arrangement. On the other hand, individual detonation of the charges permits perforations to be made at various selected depths, and in various selected (often widely separated) zones. As each charge is detonated, the string can be repositioned to the next level where another perforation is desired, and another gun fired. This process can continue until the proper perforation spacing is obtained with the desired number of shots. A further benefit is obtained from the single detonation of the guns—verification that each gun fired and that the proper number of perforations was obtained.

However, the selection and firing of a single gun in the string may involve failures which would prevent the proper firing of the modules. A failure could occur in the gun to be selected that would prevent it from firing; a failure could occur causing the firing of a wrong gun which will be eventually detected; or a failure could occur which caused the undetected firing of a wrong gun. Any one of these failures, especially in many of the prior art devices, would defeat the purposes of having selective firing of the guns in the perforation operations.

Many selective firing systems and methods have been used in the prior art to select a gun for firing from among the plurality of guns in the string. U.S. Pat. No. 4,051,907 discloses one such system comprising a surface control unit for controlling the selection and firing of the guns in a firing string comprised of a subsurface master unit operatively connected to a plurality of identical slave sub units or firing modules that may be armed and fired in an arbitrary order under control of the master unit and an operator.

Sequencing through the firing modules for selection of a module to be fired is under control of the surface located control unit. The selection process begins at the uppermost firing module closest to the master unit. Each firing module contains a pulse counter which receives pulses from the surface via the master slave unit when that module has been connected to the firing line power. A predetermined number of pulses (8 pulses) sequences the counter through nine counts. At selected counts, certain operations are effected in the module. For example, at count 4 a current pulse is placed on the firing line, at count 5 a switch is closed to charge a firing capacitor with the voltage currently on the firing line, at count 6 a firing pulse whose amplitude is equal to the current voltage on the firing line is applied to a blocking zener diode which is connected to a firing switch (the firing switch is not closed because the voltage on the firing line is not greater than the break over voltage of the zener diode), and at count 9 a pass-through switch is closed to pass the firing line power on down to the next lower module in the string.

The above described process is then repeated for the next module to be connected to the firing line power. As long as eight pulses are issued without a change in the firing line power, the sequencing through the firing modules will continue, one at a time. When the firing module to be selected and fired is reached, only six pulses will be issued by the master unit under control of the operator. These six pulses take the pulse counter in the firing module to be selected to a count of five which closes the switch which connects the firing line to the firing capacitor. At this point, the operator at the surface activates the arm switch which raises the firing line voltage, and thus the voltage on the firing capacitor, to a value sufficient to detonate the charge when the capacitor is discharged into the blasting cap. Six pulses arm the firing module with one more pulse causing a closing of the firing switch to occur since the firing line voltage is now greater than the blocking zener diode voltage to permit the firing switch to be closed. Closure of the firing switch connects the firing capacitor across the blasting cap circuit.

These prior-art selective perforating systems, such as that disclosed in U.S. Pat. No. 4,051,907, suffer from several disadvantages. One disadvantage is the need for elaborate surface and subsurface circuitry with continuous supervision and interaction required between the surface and subsurface circuitry during the selection process to effect the selection and arming of the firing modules. Another disadvantage is that sequencing through the firing modules is solely under control of the surface equipment. Another disadvantage is the lack of any safeguards for detecting faults in the firing string which will prohibit the proper firing of a single selected module.

Accordingly, it would be advantageous to provide a single-wire selective perforating system which provides for the automatic sequencing through the firing modules in a sequence, one at a time, under control of the modules themselves until a module to be selected is receiving power from the firing line. At that time, the module can be selected. It would also be advantageous to provide a single-wire selective perforating system which includes safeguards for determining if a single module has been connected in the sequence to the firing line and is operating within predicted power limits thereby insuring that one module is being selected for firing and only that module will be fired by the firing pulse.

SUMMARY OF THE INVENTION

In accordance with the present invention, a single-line selective perforating system having a single firing line for electrically connecting a firing control unit to each of a plurality of shot modules is disclosed. Connection of the control unit to the shot modules occurs one at a time in a predetermined sequence where each module is adapted for connecting the connected control unit to a next module.

The method of selecting a module for firing includes the step of connecting each module one at a time in the predetermined sequence to the firing line under control of module active time intervals. The module active time intervals are generated internally in the modules, where each module generates an active time interval in response to being connected to the firing line and where the next module in the sequence is automatically connected to the firing line at the end of the active time for the last connected module if that module was not selected for firing during its active time interval.

Also included in the method are the steps of generating during the active time interval for each module an identification pulse which uniquely identifies the module to the control unit so that selection of the module to be selected can occur when that module is generating its active time interval. Selection of a module terminates generation of the selected module's active time interval and inhibits further sequencing of the modules.

The step of connecting each module to the firing line comprises the steps of first applying power to the firing line in the form of voltage and current for powering the modules connected to the firing line. Next, a module active time interval is generated in the module last connected to the firing line power. At the completion of the last connected module's active time interval, a pass-through switch is controlled to connect the firing line power to the next module in the sequence. Finally, the steps of generating a module active time interval, an identification pulse and controlling the pass-through switch are repeated until the module to be selected is generating an active time interval. During the time interval for the module to be selected, the control unit may generate a selection pulse to select the module for firing thereby terminating further sequencing of the modules.

In a narrower aspect of the invention, the step of generating a module active time interval comprises the step of generating a time interval having a first portion during which the unique identification pulse (signal) for each module is generated, and a second portion during which the module is enabled to receive a selection pulse from the control unit to select the module for firing.

In a narrower aspect of the invention, the step of generating the uniquely identifying pulse to identify a specific module includes the step of generating a predetermined number of current pulses in the firing line power where the time interval to generate the current pulses represents the identification pulse for the module. The method also includes the step of providing each module with a different predetermined time base for generating the current pulses whereby the time intervals of the identification pulses for the modules are each different.

The method further includes the step of connecting the shot in the selected module to the firing line when the module is selected for firing whereby a firing pulse on the firing line can then detonate the selected shot. The step of connecting the shot to the firing line includes the step of generating a predetermined increase in the firing line current in response to a first arming control pulse where the current increase indicates that a single module is responding to the arming control pulses. Also included is the step of removing the predetermined current increase in response to a second arming control pulse, and the step of connecting the shot to the firing line in response to a third arming control pulse generated if the predetermined increase in firing line current was within acceptable limits.

In a narrower aspect of the invention, the shot is detonated by a firing control pulse on the firing line after the third arming control pulse.

The method also includes the further step of generating a power reset in each module when each module is first connected to the firing line power thereby initiating the active time interval for that module.

In another aspect of the invention, a single-wire selective perforating system for selectively detonating, one at a time, a plurality of charges is disclosed. The system includes a control unit operatively connected to the charges by a single firing line which carries both power and control signals between the control unit and the charges. A plurality of selectable firing modules is also included. These modules are vertically connected, one to another, to form an elongated assembly suitable for lowering into a well borehole where the assembly also includes the control unit. Each module contains at least one charge and where each module is automatically connected one at a time to the firing line in a predetermined sequence to receive power therefrom.

In response to receipt of power on the firing line, each module internally generates a module active time interval during which the module and its charge may be selected for firing by the control unit. Each module not selected for firing during its active time interval automatically connects the firing line to the next module in the sequence at the end of the active time interval. Each module also generates in the control unit during this active time interval an identification pulse which uniquely identifies the module.

The control unit includes a means for detecting the amount of power or current present on the firing line thereby to detect when each module has been connected to the firing line. A means for generating control signals on the firing line during the module active time interval is also included in the control unit. The control signals generated by the control unit include a selecting control signal for selecting the module to be selected for firing, a sequence of arming control signals for connecting the charge in a selected module to the firing line, and a firing control signal for detonating the charge in the module selected and armed for firing.

The firing line in each of the firing modules includes both an input and an output portion. Each firing module also includes an identification signal generator responsive to the receipt of power on the input portion of the firing line for generating an identification signal to said control unit indicating that a particular one of the module has been connected to the firing line. Also included is a module active time interval generator responsive to the identification signal generator for generating the module active time interval during which the module is enabled for selection for firing. A stop pulse detector responds to the selection control signal on the input portion of the firing line and to the time interval generator to terminate both the generation of the module active time interval and further module selection. Also included is an arming circuit responsive to the sequence of arming control signals and the stop pulse detector for connecting the charge in a selected module to the firing line thereby arming the module for firing. A pass-through switch is included for connecting in response to the module active time interval generator the input portion of the firing line to the output portion at the end of the module active time interval thereby connecting power to a next firing module in the assembly.

In a narrower aspect of the invention, the identification signal generator comprises a power reset circuit responsive to the receipt of power on the input portion of the firing line for generating a power reset pulse to initiate the active time interval for the module, and a first load connect means responsive to the power reset pulse for generating a predetermined number of pulses on the firing line where the time required to generate the predetermined number of pulses represents the identification signal which uniquely identifies the module.

The firing module active time interval generator comprises a clocking oscillator for generating a digital time base clocking signal to clock a binary counter. The binary counter counts a predetermined number of clock pulses to determine the length of the module active time interval. The counter outputs a first signal when a first portion of the time interval has occurred and outputs a second signal when a second portion of the time interval has occurred.

During the first portion of the time interval, the identification signal is generated, and during the second portion of the time interval, the module is enabled to receive the selection control signal.

The stop pulse detector comprises a means for detecting control signals on the input portion of the firing line where a control signal received during the second portion of the active time interval selects the module for firing. A disabling means is also included for disabling the clocking signals to the binary counter thereby terminating further module sequencing if a selection pulse was received during the second portion.

The arming circuit includes a second load connect means responsive to the stop pulse detector and to a first and a second arming signal for generating a pulse of predetermined magnitude to said control unit to indicate that only one module is responding to the arming signals. Also included is a charge connect switch responsive to a third arming control signal and to the stop pulse detector for connecting the input portion of the firing line to the charge thereby arming the module for firing.

BRIEF DESCRIPTION OF THE DRAWINGS

For a fuller understanding of the present invention, reference should be had to the following detailed description taken in connection with the accompanying drawings in which.

BRIEF DESCRIPTION OF THE PREFERRED EMBODIMENT OF THE INVENTION

Figure 1:
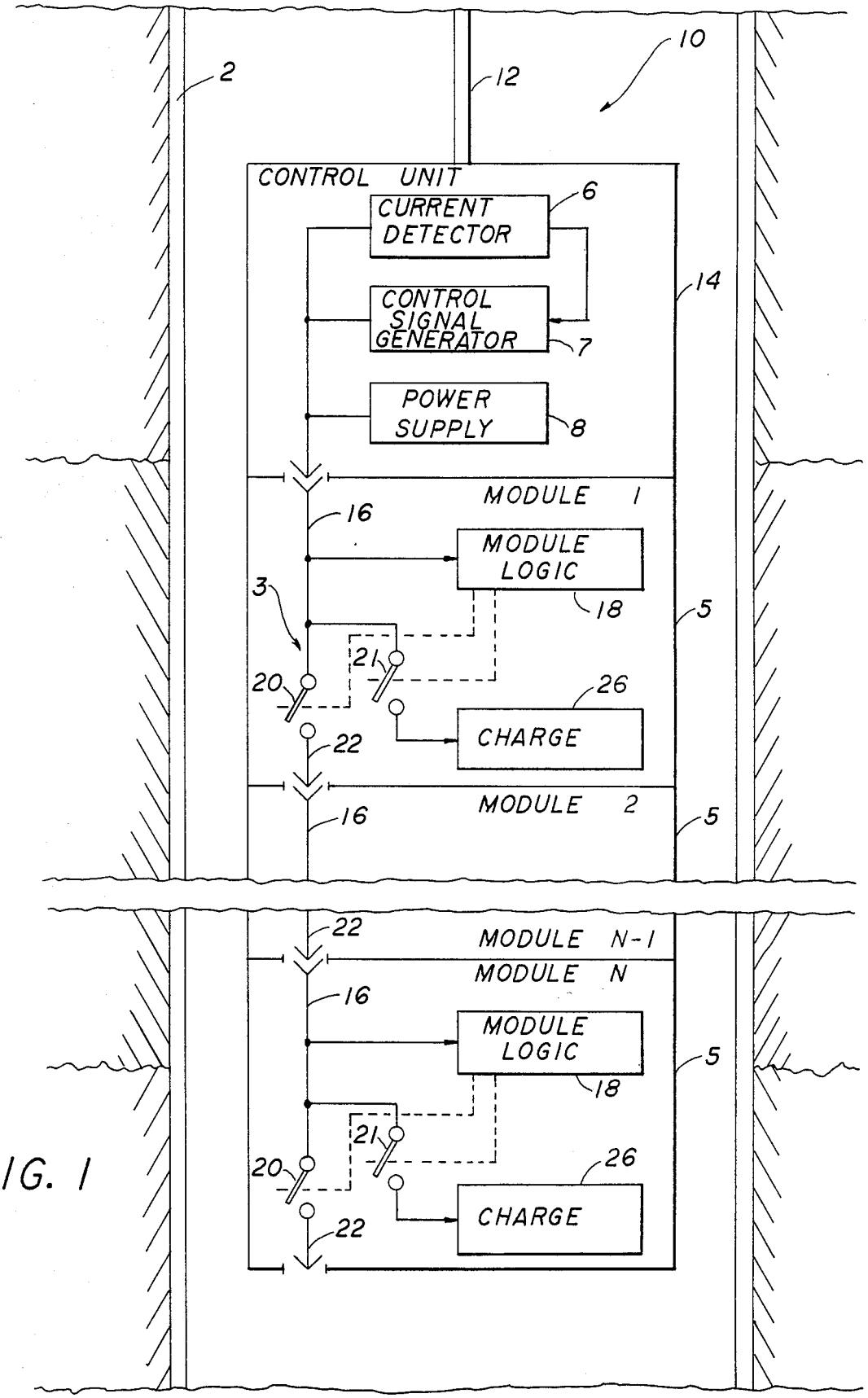
FIG. 1 is an illustration of the single-wire selective perforation firing string of the present invention as shown suspended in a well borehole.

Referring now to the figures and first to FIG. 1, a single-wire selective perforation firing string 10 according to the present invention is shown suspended by a cable 12 in a well borehole 1 which includes a well casing 2. The firing string 10 includes a control unit 14 connected to the cable 12 at the uppermost end. Connected one to another below the control unit 14 is a plurality of identical firing modules 5 to form an elongated assembly suitable for lowering into the well borehole 1.

Control unit 14 contains a current detection means 6 for detecting the amount of current in the firing line 3; a control signal generator 7 for generating control signals to the firing modules to select and arm for firing a module to be selected and to generate a firing pulse to detonate the module selected and armed for firing; and, a controllable power supply 8 for generating the voltage and current needed to power the firing modules.

Each of the firing modules 5 contains at least one shaped charge 26 with an associated detonator 24 to form a shot or gun for blasting a hole through the well casing 2 into the subsurface formations. Also include in each module is a module logic circuit 18 which functions in cooperation with the control unit 14 and the signals on the firing line 3 to sequence through the modules and to select a desired module for firing. The firing line 3 is generally indicated in FIG. 1 by the segmented signal leads 16, 22 contained in each of the modules 5. As will be discussed below, the firing line from the control unit 14 to the various modules 5 consists of a series of segmented leads which are electrically connected together in sequence to form a single firing line 3. This connection of the firing line segments occurs as the various modules are connected one at a time in a prescribed sequence to the control unit 14.

Each module 5, when physically connected to another module in the string 10, makes electrical contact with a portion of the firing line of the module to which it is connected. That is, the input portion 16 of the firing line of the module last connected to the string makes electrical contact with the output portion 22 of the next upper module, and so on up the string to the control unit 14. The module 5 just below the control unit 14 is connected to the beginning of the firing line 3, and is connected directly to the output of the controllable power supply 8.

Still referring to FIG. 1, each firing module 5 also contains a controllable switch means generally illustrated by switches 20 and 21. The switches 20, 21 respond to the module logic circuit 18 to either connect the input portion 16 of the firing line 3 coming into the module to the output portion 22 to pass power to the next module in the string (via switch 20), or to connect the input portion 16 of the firing line 3 to the detonator 24 of the shaped charge 26 (via switch 21). If switch 21 is closed in a module 5, that module would be the module selected for firing and the module logic circuit 18 of the selected module would inhibit further sequencing of lower modules in the string 10 by failing to close switch 20.

Each module logic circuit 18 contains a means for generating an internal time interval during which the module is "active." Only during the active time for a module can the module be selected and armed for firing by the control unit 14. In those modules sequenced but not selected during their respective active time intervals, the pass-thru switch 20 could also include switching (not shown) to by-pass their associated charges so that accidental firing cannot occur.

Sequencing of the selectable firing modules begins with generation of an active time interval in the uppermost module connected to the control unit 14. The uppermost module receives power from the control unit 14 to begin its active time interval when power is first applied by the controllable power supply 8 to the firing line 3. Thereafter, as each firing module generates its active time interval and is not selected for firing, the next lower module in the string is then connected to the firing line. This process continues until the lowermost module has executed its selection sequence or until a module to be selected was selected for firing during its active time interval.

Figure 2:
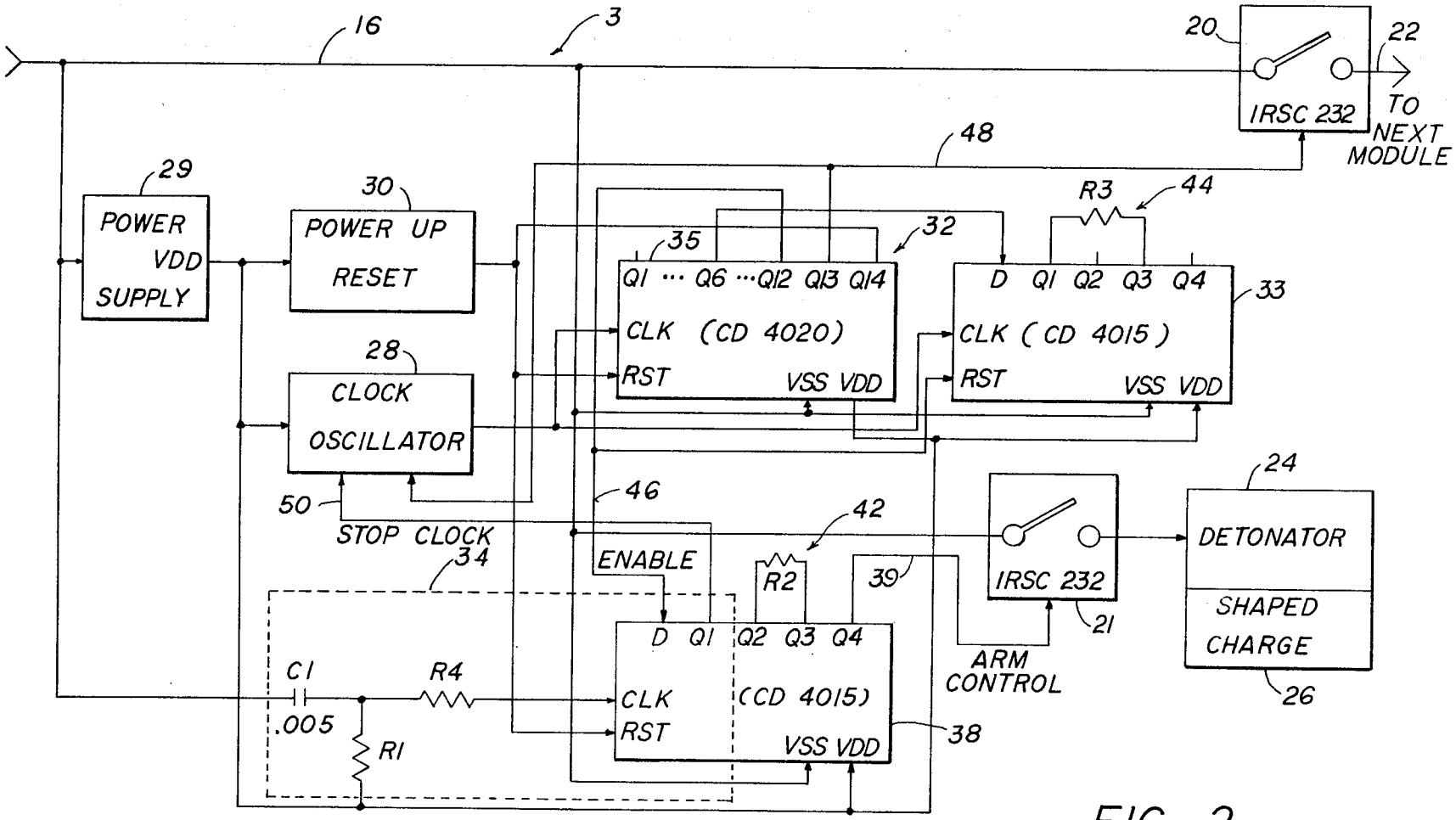
FIG. 2 is a functional block diagram of a typical firing module illustrated in FIG. 1.

The selection process for each firing module 5 is best described with reference to FIG. 2 which illustrates the functional block diagram for a typical firing module 5. Referring now to FIG. 2, the input portion 16 of the firing line 3 is shown connected to a regulated power supply 29 which produces the supply voltage for the circuits of the module. For purposes of the following discussion, it is assumed that the firing module shown in FIG. 2 has just been connected to the firing line power by the closure of switch 20 in the module immediately above.

The firing line is also shown connected to a control pulse detector 34. The control pulse detector 34 consists of a R-C network to shift the DC level of the control pulse which is applied directly into the clock input of a 4-bit shift register 38. The shift register's clock input stage acts as a comparator to detect the control pulses.

The control pulse detector 34 generates on the Q1 output of shift register 38 the signal STOP CLOCK in response to a selection control signal on the firing line during the active time interval. The selection control signal, if received at the proper time during the active time interval, selects the module for firing by terminating the module's active time interval which prohibits switch 20 from thereafter closing and passing power to the modules below the selected module. In addition to detecting a selection control signal on the firing line, the control pulse detector 34 detects the sequence of arming control signals from the control unit 14. This sequenee of arming control signals is used as a safeguard detection method for determining if one and only one firing module 5 is responding to the arming sequence.

Still referring to FIG. 2, the last three stages of the 4-bit register 38 comprise an arming circuit which responds to the sequence of arming control signals detected by the control pulse detector 34 to generate a feedback current pulse to the control unit 14. This feedback current pulse on the firing line 3 functions to indicate to the current detection means 6 in the control unit 14 that one and only one firing module is responding to the sequence of arming control signals. As will be discussed below, this feedback current pulse acts as a safeguard detection method for potential problems which would result in the improper firing of the perforation guns.

As mentioned previously, the arming sequence feedback current pulse on the firing line 3 has a predetermined amplitude of current increase over the firing line steady state current to indicate that only a single firing module is responding. The 4-bit shift register 38 operates to produce this predetermined current pulse in the firing line as follows: As long as the signal on line 46 into shift register 38 (the data (D) input) is at a logic 0, any detected control signals or pulses on the firing line will sequentially shift logic 0s into the various stages of the shift register 38. Logic 0s in the stages of the shift register 38 represents the reset condition. Thus, any pulses detected by pulse detector 34 when the D input to shift register 38 is at a logic 0 will result in no change in the logic state of the shift register, and thus no action by the arming circuit.

When the data input to shift register 38 is at a logic 1, the first control signal detected by the stop pulse detector 34 on the firing line will shift a logic 1 into the first stage of the register. As previously discussed, the output of the first stage, Q1, is the signal STOP CLOCK which is applied to signal line 50. The function of STOP CLOCK is to inhibit an oscillator clock 28 which is the internal time base for the logic circuits 18 from generating further clocking signals. The absence of further clocking pulses terminates the generation of the module's active time interval and further sequencing of any lower modules. This first received control signal represents the selection control signal for selecting a module for firing. In other words, if STOP CLOCK goes to a logic 1, this module will be selected for firing. The conditions under which the D input shift register 38 is at a logic 1 are discussed in more detail below.

Any further control signals detected by the stop pulse detector 34 when the D input is at a logic 1 will cause a corresponding logic 1 to be shifted into each of the stages of the shift register 38, with the logic 1 shifted for each control signal detected. Connected between the output of the second stage, Q2, and the third stage, Q3, of the shift register 38 is a resistor R2.

In accordance with the present invention, if the module is selected for firing by receipt of a selection control signal at the proper time, a series of arming pulses will then be generated by the control unit 14 to the arming circuit of the selected module 5 to generate the arming status feedback current pulse indicating that a single module is responding. This sequence of arming control signals consists of three pulses on the firing line. The first pulse causes the Q2 output of shift register 38 to go to a logic 1. At this time, the Q3 output of the shift register 38 is at a logic 0 thereby causing the 4-bit register 38 to supply current through R2 in the direction Q2 to Q3. This results in an increase in the amount of current drain on the power supplied by the firing line in an amount determined by the magnitude of R2. If a single firing module is responding, a predetermined current increase results.

With receipt of the second arming pulse, a logic 1 will also be shifted into the third stage of the shift register 38 resulting in both sides of resistor R2 being at a logic 1. This logic condition removes the current increase in the firing line current back to the current level for the reset condition of the arming circuit 38. Thus, if the amplitude of the current pulse increase in the firing line current as a result of the first and second arming pulses was within acceptable limits, the control unit 14 may then proceed to arm the module for firing.

Arming of the module for firing is accomplished by issuing a third arming control signal on the firing line 3. This results in the fourth stage, Q4, of shift register 38 becoming a logic 1. The Q4 output of shift register 38 is applied to signal line 39 as the signal ARM CONTROL. The signal ARM CONTROL is supplied to the controllable arming switch 21. For the present invention arming switch 21 and pass-through switch 20 are each solid state switches manufactured by International Rectifier as its model IRSC 232. Closure of switch 21 connects the detonator 24 for the shaped charge 26 to the input portion 16 of the firing line 3 thereby arming the module for firing.

As previously discussed, selection and arming of the module for firing occurs when a control signal is detected by the stop pulse detector 34 when the data input, D, to the 4-bit shift register 38 is at a logic 1. The data input to the shift register 38 is at a logic 1 during a portion of the modules active time interval and is generated as follows: A clock oscillator circuit 28 is provided as the module time base for generating clock pulses that will be counted by a 14-bit binary counter 35 to generate the active time interval for the module.

Figure 3:
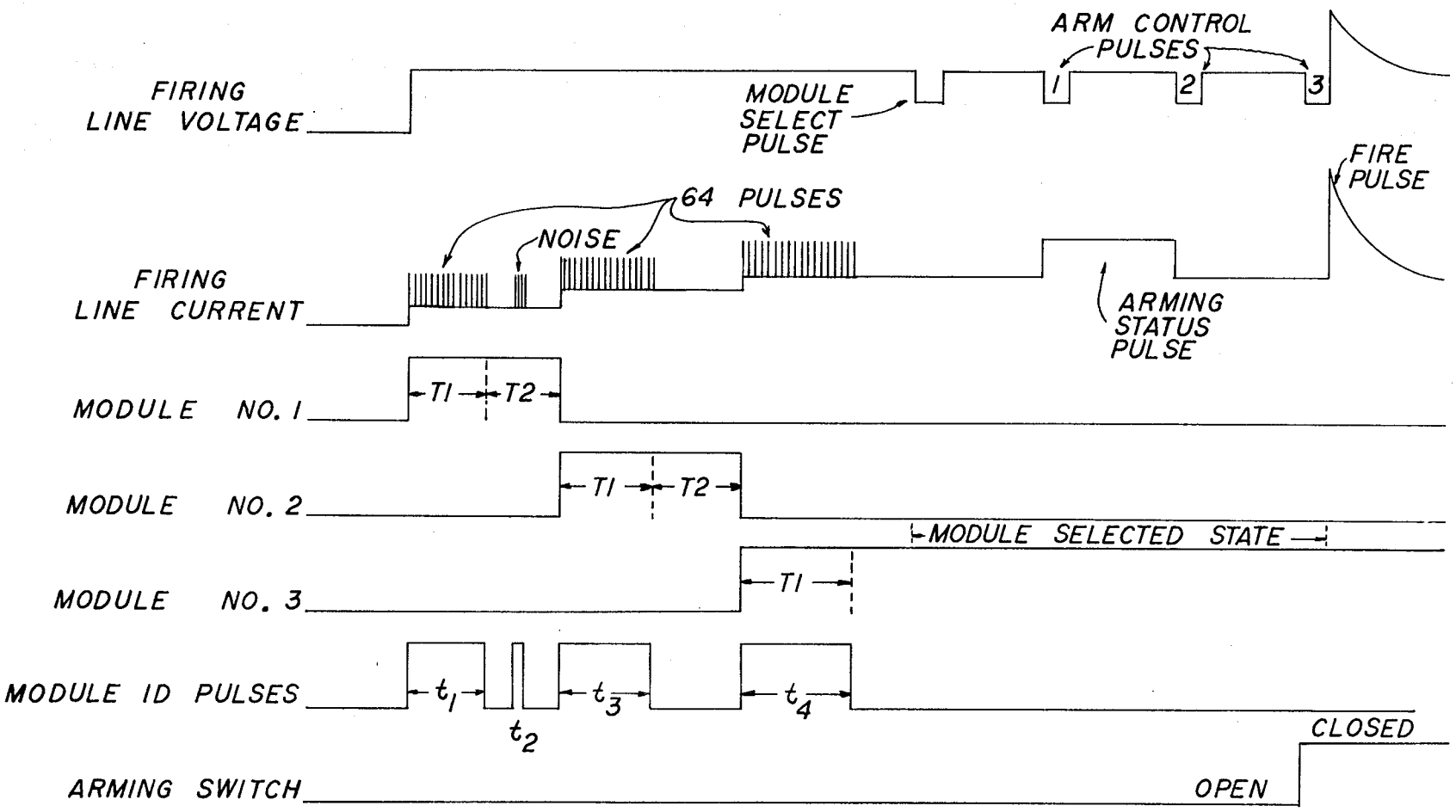
FIG. 3 is a timing diagram illustrating operations of the present invention for selecting, arming and firing a selected module in the firing string.

In accordance with the present invention, the active time interval for each module is divided into two equal portions, T1 and T2 (see FIG. 3). During the first portion T1, the module will perform an identification process whereby the module 5 generates a plurality of feedback pulse to the control unit 14. The pulses are processed by the control unit 14 to uniquely identify which module 5 is currently generating an active time interval. In the referenced co-pending application Ser. No. 394,948, each firing module generates a single feedback pulse to the control unit during the first portion of the active time interval. This single current pulse does not uniquely identify the module which generated it. Rather, the pulse is used as a safeguard detection method for proper operation of the firing string. The amplitude of the pulse and its occurrence within a predetermined time window measured from the occurrence of the last identification pulse must be within acceptable limits before the module will be selected and armed for firing. Additionally, the pulse is detected by the control unit 14 and counted in order to identify which module is currently generating an active time interval. For such an arrangement, an improper module which does not generate an active time interval and passes the firing line power on down to the next module will result in the erroneous firing of a wrong gun since the control unit will be one count off in its count of which module 5 is generating the active time interval.

The D input to shift register 38 is a logic 0 during the first portion T1 of the active time interval and prevents any selection of the module for firing. During the second portion T2 of the active time interval, the module is "enabled" to be selected, armed and fired by the control unit 14. During T2 the D input to shift register 38 is at a logic 1. The D input logic level is controlled by the 14-bit binary counter 35 whose operation is described in more detail below.

As mentioned previously, during the first portion of the module active time interval, a uniquely identifying pulse is generated in the control unit 14 to identify which module 5 is currently generating an active time interval. The generation of this uniquely identifying pulse occurs as follows: An identification signal generator comprised of the power-up reset circuit 30 and a 4-bit shift register 33 is provided with each firing module 5 for generating a plurality of feedback current pulses to the control unit 14 during the first portion of a module's active time interval. The power-up reset circuit 30 produces a power reset pulse to clear the logic 18 circuits on receipt of power on the input portion 16 of the firing line.

The 4-bit shift register 33 functions in a similar way to the shift register 38. That is, if the data input D is at a logic 1, clock pulses will cause a logic 1 to be shifted through the various stages of the register.

As shown in FIG. 2, the clock source for the shift register 33 is the output of the oscillator clock 28. The data input for shift register 33 comes from a 14-bit binary counter 35 which also responds to the clock 28. The Q6, or the output of the sixth stage of the binary counter 35, is applied as the data D input to the shift register 33. Thus, a sequence of 1s and 0s will be clocked through the shift register 33 in response to the changes in logic states of the Q6 output of the binary counter 35. A resistor R3 is connected between the Q1 and the Q3 output of the shift register 33 and operates in a manner similar to R2 to create a current increase in the firing line power when there is a difference in the logic states of Q1 and Q3. In accordance with the present invention, resistors R2 and R3, acting in cooperation with the shift registers 38 and 33, respectively, represent a first and a second load connect means for generating current increases on the firing line 3.

The Q13 output of the binary counter 35 is also applied to signal line 48 as the control input to the solid state by-pass switch 20 which responds to the logic state of Q13 to connect the input portion 16 of the firing line to the output portion 22 thereby powering up the next lower module in the string. The stopping of oscillator clock signals on the occurrence of a logic 1 on the Q13 output will thereafter keep the pass-through switch 20 closed until the power on the firing line is removed.

As previously mentioned, the active time interval for the module will be determined by the time required to count a predetermined number of clock cycles of the clock 28. For the present invention, the first portion of the module active time interval T1 is measured from the application of the firing line power to the module (the occurrence of the power reset pulse) up to the time that the Q12 output of the binary counter 35 goes to a logic 1. The second portion T2 of the module active time interval is measured by the length of time that Q12 is at a logic 1 (the length of time from when Q12 goes to a logic 1 until when Q13 goes to a logic 1).

As shown in FIG. 2, the output Q13 of the binary counter 35 is applied as a second enable input to the oscillator clock 28 to also inhibit the generation of any clock signals when Q13 is at a logic 1. The disabling of the clock 28 when Q13 is true (logic 1) indicates that the module active time interval for this module has been completed without this module being selected for firing, and until the power on the firing line is removed, this module will be in a by-passed state.

Having the ability to uniquely identify each module that is generating an active time interval, the control unit 14 can know precisely if the module currently generating an active time interval is the module to be selected and armed for firing. A faulty module which does not generate downhole an active time interval can be detected from the absence of its uniquely identifying pulse envelope in the sequence of envelopes for the modules when all the modules are sequenced and none is selected for firing.

For the preferred embodiment of the present invention, each module generates 64 current pulses on the firing line during T1. The control unit 14 will count the pulses received during T1 of each module's active time interval to determine the amount of time required by the module to generate the 64 pulses. The time interval thus developed represents the envelope of the feedback identification signal from a particular module. Since the oscillator clock circuits will vary somewhat, each module is likely to produce a pulse envelope that is unique to the module.

To insure that this is the case, each firing module oscillator clock 28 can be slightly altered to produce unique envelope pulses for each module, and this envelope can be measured uphole or downhole to uniquely identify each module. In this way, there is no need to count how many modules have been connected to the firing line in the selection sequence. The uniquely identifying pulse determines when a given module is connected to the firing line and generating an active time interval. Isolated noise pulses on the firing line will not generate an error condition because 64 pulses must be received.

While 64 pulses is the ideal number, it is possible to permit a small band or variation of total pulses received and still result in a unique identification of the module. Thus 64±n pulses are permitted and still be able to uniquely identify a given module.

Connected to the reset input of the shift register 33 is the Q12 output of the binary counter 35. Thus, the shift register 33, acting in combination with the Q6 output of the binary counter 35 and the clock 28, produces a predetermined number of short duration current pulses onto the firing line 3 until such time as Q12 goes to a logic 1. When Q12 goes to a logic 1, the shift register 33 is reset and inhibited from further generating any current pulses on the firing line. In addition to resetting the shift register 33, the Q12 output of binary counter 35 is also applied as the data D input to the shift register 38 as the signal labeled ENABLE.

Turning now to FIG. 3, a timing diagram of various signals within the single-wire perforating system according to the present invention is shown. For the signals illustrated in FIG. 3, the third module down from the control unit 14 is the module to be selected.

FIG. 3 illustrates the first and second portions of each module active time interval, T1 and T2, respectively. During the first portion T1 of each module active time interval, 64 current pulses are generated in the current signal on the firing line 3. For purposes of illustration, the time interval required to generate the 64 pulses by each of the modules is different so that the width of the resulting envelope pulse, labeled t1 through t4, are different and each pulse uniquely identifies its associated module. The noise pulses occurring between module No. 1 and module No. 2 results in a narrow pulse envelope for an identification pulse, and because it didn't contain the correct number of current pulses, it will be disregarded by the control unit 14 and reported to the surface for possible action.

Since module No. 3 is the module to be selected, the control unit 14 will generate the module selection control signal and the sequence of three arming selection control signals during the second portion T2 of the module active time interval. These control signals are applied as voltage pulses on the power voltage of the firing line. The first control signal received during the second portion of module No. 3's active time T2 will select the module for firing and thereby terminate further generation of the module active time. This, in turn, prevents further sequencing of any lower modules.

With receipt of a selection control pulse during T2 of the module active time for module No. 3, the module will enter into a selected state during which it can be armed for firing if the safeguard feedback detection sequence determines that the modules are operating properly. This safeguard detection sequence begins with receipt of the first arming control signal by the arming circuit. As previously discussed, the arming circuit produces the predetermined current pulse increase in the firing line current illustrated in FIG. 3 as the arming status pulse. The second arming pulse will be issued by the control unit 14 to remove the arming status current pulse if the proper value for the current increase was detected.

If the proper value for the arming status pulse was detected, the control unit 14 proceeds to issue a third arming control signal to cause the arming switch 21 (see FIG. 2) to close connecting the detonator 24 to the firing line 3. With the closure of the arming switch 21, the control unit 14 can then issue a firing pulse on the firing line at any time it desires to fire the module. Rather than detonating the module, however, the control unit 14 can reset the modules to select a different module by simply removing the power on the firing line without generating a firing pulse. This safety feature can be used to sequence through each of the firing modules to determine if all modules are operating properly, and to further define the unique identifying envelope for each pulse as a function of the given operating conditions that the gun is currently experiencing, since temperature variations encountered downhole may cause fluctuations in the time base in each firing module. A time base variation will change the time required to generate the 64 pulses that uniquely identifies the module.

As a redundant check to the safeguard arming status pulse during the arming sequence, the control unit 14 can determine if the modules are operating as expected by measuring the amount of current increase as each module is added to the firing line. The increase in the firing line current as each module is added to the firing line is illustrated in FIG. 3 at the start of each module active time interval as a step function.

It is one of the important features of the present invention that redundant safeguard detection methods are provided for determining faulty conditions or failures in the firing system before any attempt to fire the guns is made. These failures may be classified as failures resulting in the firing of a wrong gun which could be noticed or the failures which cause the undetected firing of a wrong gun.

As previously discussed, the response from every module during the first portion of the module's active time interval is a train of 64 feedback current pulses. The control unit 14 detects these feedback pulses and forms the envelope of the pulse train to uniquely identify the modules as they are connected to the firing line. To increase the immunity against noise on the firing line 3, the 64 pulses generated during the first portion of each module active time interval is recognized as correct if the number of pulses detected in the sequence is within a certain number of the correct number. Thus, false pulse trains, such as the noise pulses illustrated in FIG. 3, will be discarded, and the surface equipment could be informed about their occurrence.

A safeguard to the determination that the modules are functioning properly is present in the active time intervals of the various modules. The envelope of the feedback pulses during the first portion of the active time interval is a measurable time interval of approximately half the active period of the module. The control unit 14 is built to accept a wide range of active period values and is able to measure them with high resolution. Every module 5 in the gun string 10 can be individualized through a dispersion in their various clock 28 frequencies. Even if the frequencies are not made different, the frequency distribution of the various frequencies represents a random process where the difference between adjacent modules may not always be measurable, but the probability of this condition to leave a failure undetected is sufficiently low. Otherwise, the modules could be trimmed to different values of their active periods and placed sequentially in the string.

Since the present invention is able to sequence through each of the modules without firing any module, it is possible to measure, before the guns are fired, the time intervals for each of the modules. These values can form a reference table of active times versus module position which can be used later to verify the selections during the perforation operations.

Another safeguard detection system involves the measurement of the line current on the firing line 3. The control unit 14 includes a high resolution measurement of the current supplied to the firing line. After a module is selected, the current on the firing line is proportional to the number of modules connected to the line, and therefore, indicative of the module selected.

The total current drain produced by all the firing modules connected to the firing line may not be precise enough to indicate the number of modules, but the single addition or subtraction of a module on the firing line produces a predictable change in the current. With the perforating string 10 downhole and before firing the guns, reference values of supply current can be measured with selection cycles of progressive length. In other words, a selection cycle to select module No. 1 followed by a selection cycle for module No. 2, etc., can be run to determine how this increase in firing line current occurs for each module. These measurements can be made simultaneously with the identification pulse measurements.

The verification of the active time interval and line current is a safeguard in situations where a failure reduces the active period of a module to zero and the failed module powers up together with the next lower module, and is by-passed without being accounted for.

In most perforation systems where the present invention can be applied, the firing of the gun destroys the electrical line passing through it. This situation is inconvenient since it restricts the arbitrary nature of the selection, but is helpful in finding the position of the last fired gun. This can be accomplished by counting the modules still able to communicate with the control unit 14.

The number of interconnected modules is measured by a selection cycle of unrestricted length. The control unit 14 will count the feedback pulse trains, and therefore the number of modules. As the last module is by-passed, the measurement of the supply current will indicate the condition of the line below the last unfired gun. The same measurement can locate any failure in the wiring between modules. The control unit 14 can detect an open or short circuit in the line and determine up to which gun the string is still operable.

After the selection cycle in which a module is selected and armed for firing, only the active module should be able to forward the firing current to the blasting cap. But any of the by-passed modules could be defective and remain "active" after being by-passed. The module with the faulty circuitry could fire in parallel with the selected one, and eventually go undetected. As a safeguard against this failure, the selected module is not ready to accept the firing current immediately after the selection control signal is applied to the firing line 3, but requires an arming sequence of several arming control signals.

As previously discussed, arming is implemented in accordance with the present invention with three additional control pulses on the firing line 3 similar to the one used in the selection process. Only the selected modules should be able to receive these pulses.

The first arming pulse will increase by a fixed amount the supply current drained in the active module with the second pulse returning the current to its previous value. If the increase in current was within acceptable limits, a third pulse will finally close the arming switch 21 between the detonator or blasting cap 24 and the firing line 3. Simultaneously, or sometime after the third arming control pulse, the control unit 14 will connect a firing capacitor to the firing line and produce the firing current.

If a defective module is placed in any intermediate arming stage after the selection, including the state where the switch to the blasting cap is closed, the measurement of the line current before and during the arming sequence will detect this faulty condition.

Summarizing the present invention, a single-wire selective perforating gun system is disclosed in which a plurality of identical firing modules are connected, one to another, to form an elongated assembly suitable for lowering into a well borehole. Included in the assembly is a control unit for generating power and firing line signals to each of the firing modules as each module is connected, one at a time, in a sequence to the control unit.

Each of the firing modules generates internally an active time interval during which the module can be selected and armed for firing by the control unit. The active time interval begins when power is applied to the module by connection of the module to the firing line. Each firing interval has a first and a second portion. During the first portion, a unique identification pulse is generated in the control unit to indicate that a particular module from among the plurality of modules is connected to the firing line and is generating an active time interval. In this way, the control unit is able to determine when a particular module is available for selection.

During the second portion of the module active time interval, the control unit may select a module for firing by issuing a selection control pulse onto the firing line. Pulses on the firing line during the first portion of the active time interval are disregarded by the module since a module may only be selected and armed during the second portion of the time interval.

Once a module is selected, the control unit will issue a sequence of three arming signals to arm the module. The first and second arming control pulses will produce a current pulse increase on the firing line power of a predetermined amplitude to indicate to the control unit if one and only one module is responding to the arming sequence. If the current increase is within acceptable limits, the control unit will then issue a third arming control signal to connect the detonator of the charge in the module to the firing line. Once the module is armed for firing, the control unit 14 can issue a firing pulse to detonate the charge or can remove the firing line power to reset all of the modules and permit the selection process to be repeated to select a different . module.

In describing the invention, reference has been made to its preferred embodiment. However, those skilled in the art and familiar with the disclosure of the invention may recognize additions, deletions, substitutions or other modications which would fall within the perview of the invention as defined in the appended claims. For example, the invention has been described with reference to a single firing line 3 which carries both power and control signals between the control unit 14 and the plurality of firing modules 5. It will be obvious that the advantages of the present invention may be obtained by using more than one signal line to carry power and control signals from the control unit to the modules. A single line to carry the control signals for selection and arming separate and apart from the firing line power and feedback signals could be employed where the signal lines are segmented in the same way as disclosed herein.

What is claimed is:

1. In a single-line selective perforating system having a single firing line for electrically connecting a firing control unit to each of a plurality of shot modules one at a time in a sequence, where each module is adapted for connecting the connected control unit to a next module, a method of selecting a module for firing comprising the steps of:

(a) connecting each module one at a time in the predetermined sequence to the firing line under control of module active time intervals generated internal to the modules, where each module generates its own active time interval in response to being connected to the firing line and where the next module in the sequence is automatically connected to the firing line at the end of the active time for the last connected module;

(b) generating during the active time interval for each module an identification pulse which uniquely identifies the module; and (c) selecting the module to be selected by generating a selection pulse during the active time of the module to be selected thereby selecting the module for firing and terminating further sequencing of the modules.

2. The method of claim 1 wherein the step of connecting each module to the firing line comprises the steps of:

(a) applying power to the firing line in the form of voltage and current for powering the modules connected to the firing line;

(b) generating a module active time interval in the module last connected to the firing line power;

(c) controlling at the end of each module active time interval a pass-through switch to pass the firing line power to the next module in the sequence; and (d) repeating steps (b) and (c) until the module to be selected is generating an active time interval.

3. The method of claim 2 wherein the step of generating a module active time interval comprises the step of generating a time interval having, (a) a first portion during which the identification pulse which uniquely identifies the module is generated, and (b) a second portion during which the module is enabled to receive selection pulses from the control unit to select the module for firing.

4. The method of claims 1, 2 or 3 wherein the step of generating the identification pulse which uniquely identifies the module includes the step of generating a predetermined number of current pulses on the firing line where the time interval to generate the current pulses represents the identification pulse.

5. The method of claim 4 wherein the predetermined number of current pulses is 64.

6. The method of claim 4 further including the step of providing each module with a different predetermined time base for generating the identification pulse whereby the time intervals of the identification pulses for the modules are each different.

7. The method of claim 6 further including the step of connecting the shot in the selected module to the firing line when the module is selected for firing whereby a firing pulse on the firing line can detonate the selected shot.

8. The method of claim 7 wherein the step of connecting the shot to the firing line includes the steps of:

(a) generating a predetermined increase in the firing line current in response to a first arming control pulse, the predetermined increase in current indicating that a single module is responding to the arming control pulses;

(b) removing the predetermined current increase in the firing line current in response to a second arming control pulse; and (c) connecting the shot to the firing line in response to a third arming control pulse generated if the predetermined change in firing line current is within acceptable limits.

9. The method of claim 8 wherein the shot is detonated by a firing control pulse on the firing line as early as the third arming control pulse.

10. The method of claim 8 further including the step of generating a power reset in each module when each module is connected to the firing line power thereby initiating each active time interval.

11. The method of claim 3 wherein the first and second portions of each active time interval are equal in length.

12. In a single-line selective perforating system having a firing control means, a plurality of modules connected in a string adapted for insertion into a well borehole where each module is connected one to the other from an uppermost to a lowermost module with each module containing at least one shaped charge or shot for perforating a well casing into the subsurface formations, and a controllable pass-through switch means for passing a single firing line to the next lower module in the string, a method of selecting a module to be fired comprising the steps of:

(a) applying to the firing line electrical power having voltage and current of sufficient magnitude to power the modules but without sufficient power to fire a shot;

(b) generating internal to the module last connected to the firing line power a module active time interval during which the module may be armed for firing;

(c) generating during each module active time interval a uniquely identifying signature to identify to the firing control means that a particular module has been connected to the firing line; and (d) generating during a module active time interval a sequence of arming pulses to arm the module for firing if the active module is the module to be selected and is the only module responding to the sequence of arming pulses.

13. The method of claim 12 further including the step of controlling said pass-through switch means in the last connected module at the end of its module active time interval to connect the next lower module in the string to the firing line thereby powering up the next lower module.

14. The method of claim 12 wherein said step of generating a module active time interval includes the steps of:

(a) generating a first portion of the active time interval during which the identification signature to uniquely identify the module is generated and (b) generating a second portion of the active time interval during which the module is enabled to receive the arming pulses to arm the module.

15. The method of claims 12 or 14 wherein said identification signature which uniquely identifies a module is a predetermined number of current pulses on the firing line where the time interval to generate the current pulses represents the identification pulse.

16. The method of claim 15 wherein the predetermined number of current pulses is 64.

17. The method of claim 12 further including the step of connecting the shot to the firing line in response to the sequence of arming pulses comprising the steps of:

(a) generating a predetermined increase in the firing line current in response to a first arming control pulse, the predetermined increase in current indicating that a single module is responding to the arming control pulses;

(b) removing the predetermined current increase in the firing line current in response to a second arming control pulse; and (c) connecting the shot to the firing line in response to a third arming control pulse generated if the predetermined change in firing line current is within acceptable limits.

18. The method of claim 17 further including the step of firing a shot by applying a power pulse on the firing line of sufficient energy to detonate the shot in the module which has been connected to the firing line.

19. The method of claim 14 wherein the step of generating a module active time for each module includes the step of generating a power reset pulse to the module when a module is first connected to the firing line power.

20. The method of claims 18 or 19 wherein each module connected to the firing line but not armed remains connected to the firing line in an inactive state, and where the modules in an inactive state may be reset to once again be selected by momentarily removing the power from the firing line.

21. In a single firing line selective perforating system for detonating a plurality of charges in a shot string comprised of a plurality of series connected modules, each module containing a charge to be detonated by the application of a firing pulse on the firing line, and each module electrically powered by power signals from the firing line, a method of selecting and firing the modules to be fired comprising the steps of:

(a) generating internal to each module as each module is connected in turn one at a time in a sequence to the firing line power signals, a module active time interval having a first and a second portion;

(b) generating during the first portion an identifying pulse to uniquely identify which module is generating a module active time interval;

(c) generating during the second portion of the active time interval for the module to be selected a sequence of control pulses to select and arm the module for firing, the module so armed remaining armed until fired or reset; and (d) connecting to the firing line at the end of the second portion of the module active time interval for the module last connected to the firing line, the next module in the string to receive power.

22. The method of claim 21 wherein the step of generating the sequence of control pulses to select and arm the module to be selected comprises the steps of:

(a) generating during the second portion of the active time interval for the module to be selected a selection pulse to select the module;

(b) generating a predetermined increase in the firing line current in response to a first arming control pulse, the predetermined increase in current indicating that a single module is responding to the arming control pulses;

(c) removing the predetermined current increase in the firing line current in response to a second arming control pulse; and (d) connecting the charge to the firing line in response to a third arming control pulse generated if the predetermined increase in firing line current is within acceptable limits.

23. The method of claim 22 wherein the charge is detonated by a firing control pulse on the firing line at the end of the third arming control pulse.

24. In a single-line selective perforating system having a single firing line for connecting a control unit to a plurality of shot modules, each adapted to be electrically connected in a predetermined sequence to the firing line where each connected module receives both power and firing control signals from the control unit over the firing line, a method of selecting a module for firing from among the plurality of modules comprising the steps of:

(a) generating internal to each module in response to receipt of the power signals on the firing line (i) a module active time interval during which the module may be selected for firing by control signals from the control unit, and (ii) a uniquely identifying signal for transmission over the firing line to the control unit to indicate which module has been connected to the firing line; and (b) automatically connecting the firing line to the next module in the sequence at the end of the module active time for the last connected module if that module was not selected for firing during its active time.

25. The method of claim 24 wherein each module active time interval includes:

(a) a first portion during which the module generates and applies the identification signal onto the firing line, and (b) a second portion during which the module is enabled to receive selection pulses on the firing line from the control unit to select and arm the module for firing.

26. The method of claim 25 further including the step of connecting the charge in the module to be selected to the firing line comprising the steps of:

(a) generating during the second portion of the active time interval for the module to be selected a selection pulse to select the module;

(b) generating a predetermined increase in the firing line current in response to a first arming control pulse, the predetermined increase in current indicating that a single module is responding to the arming control pulses;

(c) removing the predetermined current increase in the firing line current in response to a second arming control pulse; and (d) connecting the charge to the firing line in response to a third arming control pulse generated if the predetermined increase in firing line current is within acceptable limits.

27. A single-wire selective perforating system for selectively detonating a plurality of charges comprising:

(a) a control unit operatively connected to the charges by a single firing line which carries both power and control signals between said control unit and the charges; and (b) a plurality of selectable firing modules vertically connected one to another to form an elongated assembly suitable for lowering into a well borehole, the assembly including said control unit, each module (i) containing at least one charge and where each module is automatically connected one at a time to the firing line in a predetermined sequence to receive power therefrom, and (ii) in response to receipt of power on the firing line, (1) internally generates a module active time interval during which the module and its charge may be selected for firing by said control unit, each module not selected for firing during its active time interval automatically connecting the firing line to the next module in the sequence at the end of the active time interval, and (2) generates during the active time interval an identification signal which uniquely identifies the module.

28. The system of claim 27 wherein said control unit includes:

(a) a means for detecting the amount of power current present on the firing line, thereby to detect when a module has been connected to the firing line; and (b) a means for generating control signals on the firing line including (i) the selection control signal for selecting the module to be selected for firing, (ii) a sequence of arming control signals for connecting the charge in the selected module to the firing line, and (iii) a firing control signal for detonating the charge in the module selected for firing.

29. The system of claim 28 wherein the firing line in each of said firing modules includes an input and an output portion, each said firing module comprising:

(a) an identification signal generator responsive to the receipt of power on the input portion of the firing line for generating the identification signal to said control unit indicating that a particular one of said modules has been connected to the firing line;

(b) a module active time interval generator responsive to said identification signal generator for generating the module active time interval during which the module may be selected for firing;

(c) a stop pulse detector responsive to the selection signal on the input portion of the firing line and to said time interval generator for terminating the generation of the module active time interval and for terminating further module selection;

(d) an arming circuit responsive to the sequence of arming control signals and said stop pulse detector for connecting the charge in the module to the firing line thereby arming the module for firing; and (e) a pass-through switch responsive to said module active time interval generator for connecting at the end of the module active time interval the input portion of the firing line to the output portion thereby connecting power to a next firing module in the assembly.

30. The system of claim 29 wherein said identification signal generator comprises:

(a) a power reset circuit responsive to the receipt of power on the input portion of the firing line for generating a power reset pulse to initiate the active time interval for the module; and (b) a first load connect means responsive to the power reset pulse for generating a predetermined number of pulses on the firing line where the time required to generate the predetermined number of pulses represents the identification signal which uniquely identifies the module.

31. The system of claim 29 wherein said firing module active time interval generator comprises:

(a) a clocking oscillator for generating a digital time base clocking signal; and (b) a binary counter responsive to said stop pulse detector and the clocking signal for counting a predetermined number of clock pulses to determine the length of the module active time interval, said counter (i) outputting a first signal when a first portion of the time interval has occurred, and (ii) outputting a second signal when a second portion of the time interval has occurred.

32. The system of claim 31 wherein (a) the identification signal is generated during the first portion of the time interval, and (b) the module is enabled to receive the selection pulse during the second portion of the time interval.

33. The system of claims 31 or 32 wherein said stop pulse detector comprises:

(a) a means for detecting control signals on the input portion of the firing line, a control signal received during the second portion of the active time interval selecting the module for firing; and (b) a disabling means responsive to the detecting means and to said module time interval generator for disabling the clocking signals to said binary counter thereby terminating further module sequencing if a selection pulse was received during the second portion.

34. The system of claim 33 wherein the sequence of arming signals includes a first, second and third arming control signal, said arming circuit including:

(a) a second load connect means responsive to said stop pulse detector and to the first and second arming signals for generating a pulse of predetermined magnitude to said control unit to indicate that only one module is responding to the arming signals; and (b) a charge connect switch responsive to the third arming signal and said stop pulse detector for connecting the input portion of the firing line to the charge thereby arming the module for firing.

35. A firing module for use in a single-wire selective perforating system, the system having a plurality of said firing modules vertically connected to form an elongated assembly suitable for lowering into a well borehole, the assembly including a control means for generating power and control signals on a single firing line, each firing module comprising:

(a) at least one shot, each shot including a detonator responsive to a firing pulse from said control means for detonating its associated shot;

(b) an identification pulse generator responsive to the receipt of power on the firing line for generating an identification signal to said control means indicating that a particular one of said modules has been connected to the firing line;

(c) a module active time interval generator responsive to said identification pulse generator for generating a module active time interval during which the module may be selected for firing by said control means;

(d) a stop pulse detector responsive to a selection control signal on the firing line and to said time interval generator for terminating the generation of the module active time interval, and for terminating further selection of the modules;

(e) an arming circuit responsive to a sequence of arming control signals including first, second and third arming signals for connecting said detonator to the firing line thereby selecting the module for firing; and (f) a pass-through switch responsive to said module active time interval generator for passing the power on the firing line through the module at the end of the module active time interval thereby providing power to another module in the assembly.

36. The module of claim 35 wherein said identification pulse generator comprises:

(a) a power reset circuit responsive to the receipt of power on the firing line for generating a power reset pulse to initiate the start of the module active time interval; and (b) a first load connect means for generating a predetermined number of pulses on the firing line, the time required to generate the predetermined number of pulses representing the identification signal which uniquely identifies the module.

37. The module of claim 35 wherein said module active time interval generator comprises:

(a) a clocking oscillator for generating a digital time base clocking signal; and (b) a binary counter responsive to said stop pulse detector and the clocking signal for counting a predetermined number of clock pulses to determine the length of the module active time interval, said counter (i) outputting a first signal when a first portion of the time interval has occurred, and (ii) outputting a second signal when a second portion of the active time interval has occurred.

38. The module of claim 37 wherein (a) the identification pulse is generated during the first portion of the time interval, and (b) the module is enabled to receive the selection control signal during the second portion.

39. The module of claims 37 or 38 wherein said stop pulse detector comprises:

(a) a means for detecting control signals on the firing line, a control signal received during the second portion of the active time interval selecting the module for firing; and (b) a disabling means responsive to the detecting means and to said module time interval generator for disabling the clocking signals to said binary counter thereby terminating further module sequencing if a selection signal was detected by said detecting means during the second portion of the module active time interval.

40. The system of claim 39 wherein said arming circuit includes:

(a) a second load connect means responsive to said stop pulse detector and to the first and second arming signals for generating a pulse of predetermined magnitude to said control means to indicate that only one module is responding to the arming signals; and (b) a charge connect switch responsive to the third arming pulse and said stop pulse detector for connecting the firing line to the charge thereby arming the module for firing.

41. In a selective perforating system having a plurality of signal lines including a firing line for connecting a control unit to a plurality of shot modules, each adapted to be electrically connected in a predetermined sequence to the control unit where each connected module receives both power and firing control signals from the control unit, a method of selecting a module for firing from among the plurality of modules comprising the steps of:

(a) generating internal to each module in response to receipt of the power signals from the control unit (i) a module active time interval during which the module may be selected for firing by control signals from the control unit, and (ii) a uniquely identifying signal for transmission to the control unit to indicate which module has been connected to the firing line; and (b) automatically connecting the firing line to the next module in the sequence at the end of the module active time for the last connected module if that module was not selected for firing during its active time.

42. The method of claim 41 wherein each module active time interval includes:

(a) a first portion during which the module generates the identification signal, and (b) a second portion during which the module is enabled to receive selection pulses from the control unit to select and arm the module for firing.

43. The method of claim 42 further including the step of connecting the charge in the module to be selected to the firing line comprising the steps of:

(a) generating during the second portion of the active time interval for the module to be selected a selection pulse to select the module;

(b) generating a predetermined increase in the module power current in response to a first arming control pulse, the predetermined increase in current indicating that a single module is responding to the arming control pulses;

(c) removing the pedetermined current increase in the module power current in response to a second arming control pulse; and (d) connecting the charge to the firing line in response to a third arming control pulse generated if the predetermined increase in module power current is within acceptable limits.

44. A selective perforating system for selectively detonating a plurality of charges comprising:

(a) a control unit operatively connected to the charges by a plurality of signal lines including a firing line, the lines delivering both power and control signals between said control unit and the charges; and (b) a plurality of selectable firing modules vertically connected one to another to form an elongated assembly suitable for lowering into a well borehole, the assembly including said control unit, each module (i) containing at least one charge and where each module is automatically connected one at a time to said control unit in a predetermined sequence to receive power therefrom, and (ii) in response to receipt of power, (1) internally generates a module active time interval during which the module and its charge may be selected for firing by said control unit, each module not selected for firing during its active time interval automatically connecting the firing line to the next module in the sequence at the end of the active time interval, and (2) generates in said control unit during the active time interval an identification pulse which uniquely identifies the module.

45. The system of claim 44 wherein said control unit includes:

(a) a means for detecting the amount of power current present on the signal lines, thereby to detect when a module has been connected to the firing line; and (b) a means for generating control signals to said modules including (i) the selection control signal for selecting the module to the selected for firing, (ii) a sequence of arming control signals for connecting the charge in the selected module to the firing line, and (iii) a firing control signal for detonating the charge in the module selected for firing.

46. The system of claim 45 wherein the firing line in each of said firing modules includes an input and an output portion, each said firing module comprising:

(a) an identification signal generator responsive to the receipt of power from the control unit for generating an identification signal to said control unit indicating that a particular one of said modules has been connected to the firing line;

(b) a module active time interval generator responsive to said identification signal generator for generating the module active time interval during which the module may be selected for firing;

(c) a stop pulse detector responsive to the selection signal on the input portion of the firing line and to said time interval generator for terminating the generation of the module active time interval and for terminating further module selection;

(d) an arming circuit responsive to the sequence of arming control signals and said stop pulse detector for connecting the charge in the module to the firing line thereby arming the module for firing; and (e) a pass-through switch responsive to said module active time interval generator for connecting power to a next firing module in the assembly at the end of the module active time interval.

47. The system of claim 46 wherein said identification signal generator comprises:

(a) a power reset circuit responsive to the receipt of power for generating a power reset pulse to initiate the active time interval for the module; and (b) a first load connect means responsive to the power reset pulse for generating a predetermined number of pulses to said control unit where the time required to generate the predetermined number of pulses represents the identification signal which uniquely identifies the module.

48. The system of claim 46 wherein said firing module active time interval generator comprises:

(a) a clocking oscillator for generating a digital time base clocking signal; and (b) a binary counter responsive to said stop pulse detector and the clocking signal for counting a predetermined number of clock pulses to determined the length of the module active time interval, said counter (i) outputting a first signal when a first portion of the time interval has occurred, and (ii) outputting a second signal when a second portion of the time interval has occurred.

49. The system of claim 48 wherein (a) the identification signal is generated during the first portion of the time interval, and (b) the module is enabled to receive the selection pulse during the second portion of the time interval.

50. The system of claims 48 or 49 wherein said stop pulse detector comprises:

(a) a means for detecting control signals from said control unit, a control signal received during the second portion of the active time interval selecting the module for firing; and (b) a disabling means responsive to the detecting means and to said module time interval generator for disabling the clocking signals to said binary counter thereby terminating further module sequencing if a selection pulse was received during the second portion.

51. The system of claim 50 wherein the sequence of arming signals includes a first, second and third arming control signal, said arming circuit including:

(a) a second load connect means responsive to said stop pulse detector and to the first and second arming signals for generating a pulse of predetermined magnitude to said control unit to indicate that only one module is responding to the arming signals; and (b) a charge connect switch responsive to the third arming signal and said stop pulse detector for connecting the input portion of the firing line to the charge thereby arming the module for firing.

* * * * *